US006409530B1

(12) United States Patent
Zhao et al.

(10) Patent No.: US 6,409,530 B1
(45) Date of Patent: Jun. 25, 2002

(54) POWER JACK

(75) Inventors: Qijun Zhao; ZiQiang Zhu; Jinkui Hu, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/997,035

(22) Filed: Nov. 28, 2001

(51) Int. Cl.[7] ..... H01R 29/00
(52) U.S. Cl. ..... 439/188; 439/490
(58) Field of Search ..... 439/489, 490, 439/188, 668, 944

(56) References Cited

U.S. PATENT DOCUMENTS 5,924,889 A * 7/1999 Wang ..... 439/490
6,162,078 A * 12/2000 Chung ..... 439/188
6,322,397 B1 * 11/2001 Zhang ..... 439/188

* cited by examiner

*Primary Examiner*—Tho D. Ta
(74) *Attorney, Agent, or Firm*—Wei Te Chung

(57) ABSTRACT

A power jack (1) comprises a front housing (2), a rear housing (3) assembled on the front housing, a mating contact (4), a spring contact (5), a switch contact (6), a tail contact (7), and an LED (8). The mating contact is assembled in both the front housing and the rear housing. The spring contact and the switch contact are assembled in the front housing. The tail contact is riveted on the mating contact. The LED is assembled on the front housing and the rear housing to indicate the working status of the power jack.

8 Claims, 6 Drawing Sheets

POWER JACK

BACKGROUND OF THE INVENTION

1. Field of the Invention

The present invention relates to a power jack, and particularly to a power jack with an LED (light-emitting diode) indicating the working status of the power jack.

2. Description of Related Art

Power jack is widely used in electrical equipments to transmit direct current. Generally, a conventional power jack comprises a mating contact and a plurality of plate spring contacts arranged around the mating contact to electrically contact with the mating contact. The spring contacts are electrically connected to a mating printed circuit board (PCB). In mating, a mating plug connector electrically contacts with the mating contact. Therefore, a current flowing between the plug connector and the PCB is achieved. When the electrical connection between the mating plug connector and the PCB becomes faulty, it is important that the fault be quickly identified and the problem be solved so that the downtime is kept to the minimum. To identify a transmission fault, it must be checked whether current is being transmitted or not. However, conventionally, it is difficult to identify such transmission fault, since no indicating device is employed.

Hence, an improved power jack is required to indicate the current transmitting status of the power jack.

SUMMARY OF THE INVENTION

Accordingly, the object of the present invention is to provide a power jack with an LED indicating the working status of the jack.

In order to achieve the object set forth, a power jack in accordance with the present invention comprises a front housing, a rear housing assembled on the front housing, a mating contact, a spring contact, a switch contact, a tail contact, and an LED. The mating contact is assembled in both the front housing and the rear housing to contact with a complementary plug connector. The spring contact and the switch contact are assembled in the front housing, contacting with each other and being welded on a mating printed circuit board. The tail contact is riveted on the mating contact and welded on the printed circuit board. The LED is assembled on the front housing and the rear housing to indicate the connection status between the plug connector and the printed circuit board. When the plug connector is inserted into the front housing, and contacts with the mating contact and the spring contact, the spring contact disengages from the switch contact, thereby establishing a current path between the plug connector and the printed circuit board. In this case, the LED is on, otherwise the LED is off.

Other objects, advantages and novel features of the invention will become more apparent from the following detailed description when taken in conjunction with the accompanying drawings.

DETAILED DESCRIPTION OF THE INVENTION

Figure 1:
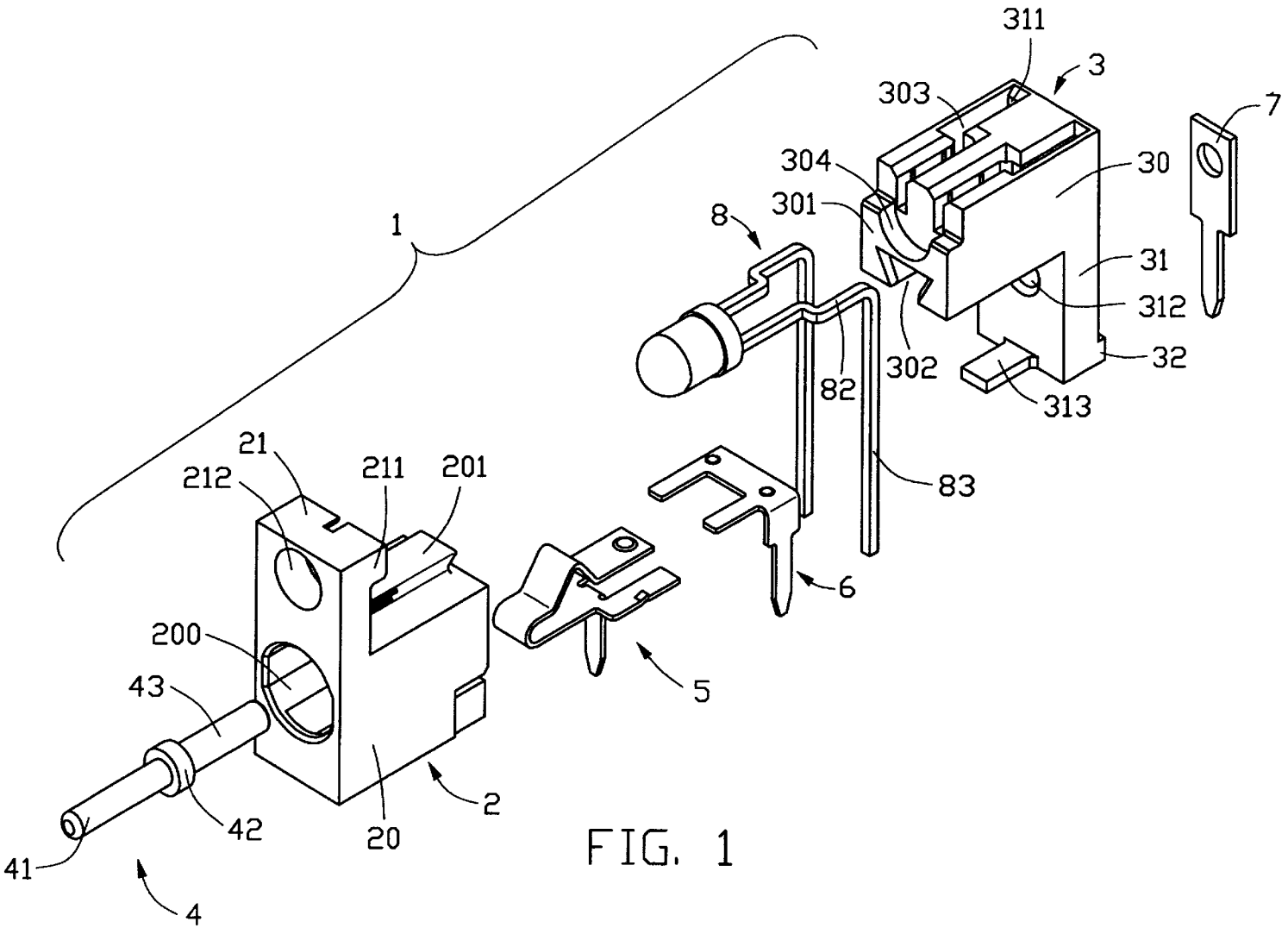
FIG. 1 is a perspective, exploded view of a power jack of the present invention.

Reference will now be made to the drawing figures to describe the present invention in detail.

Figure 2:
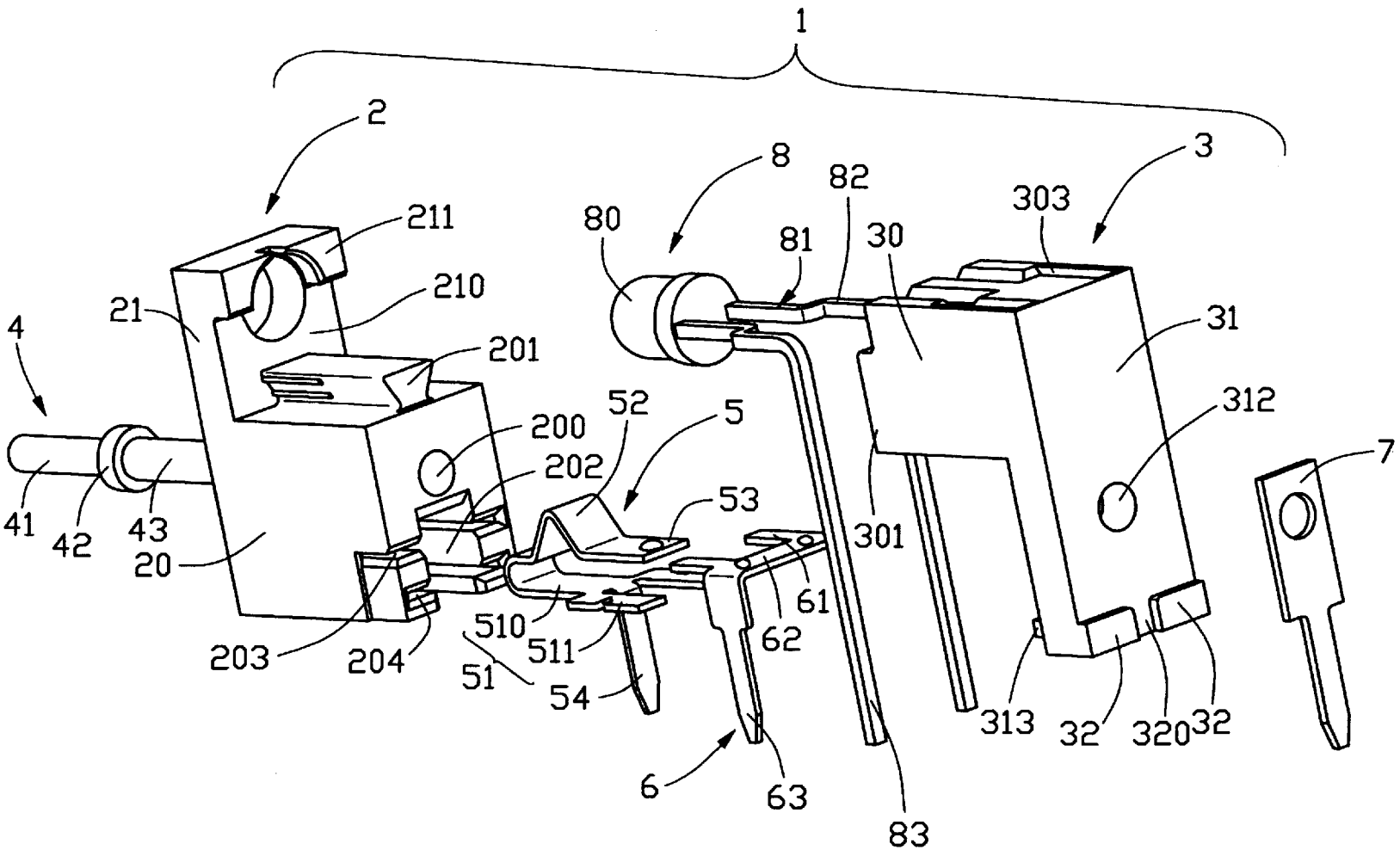
FIG. 2 is a perspective, exploded view of the power jack in FIG. 1 from a rear direction.

Referring to FIGS. 1 and 2, a power jack 1 of the present invention comprises a front insulative housing 2, a rear insulative housing 3, a mating contact 4, a spring contact 5, a switch contact 6, a tail contact 7, and an LED 8.

The front housing 2 is substantially L-shaped and comprises a bottom base 20 and a top portion 21 extending upwardly from a front end of the bottom base 20. The top portion 21 comprises a rear projection 211 extending rearwardly from a top end thereof, and a longitudinal through hole 212. The rear projection 211 and the bottom base 20 define a retaining recess 210 therebetween. The bottom base 20 comprises a longitudinal receiving passage 200 to receive the mating contact 4 and a contact of a complementary plug connector 9 (only shown in FIG. 6), and a longitudinal wedge 201 extending upwardly from a top face thereof. The bottom base 20 further comprises a rearwardly and downwardly exposed rectangular recess 202, a pair of opposite upper slots 203 extending inwardly from a rear face, and a pair of opposite lower slots 204 extending inwardly from the rear face thereof. It should be noted that the upper and lower slots 203, 204 are communicated with the rectangular recess 202, and one of the upper slots 203 is transversely exposed.

The rear housing 3 is substantially L-shaped and assembled on the front housing 2 from a back-to-front direction. The rear housing 3 comprises a top base 30, a vertical portion 31 extending downwardly from a rear end of the top base, and a pair of bottom portions 32 extending rearwardly from a bottom end of the vertical portion 31. The top base 30 comprises a front projection 301 extending forwardly from a bottom end thereof, a dove-tailed recess 302 in a bottom face thereof for receiving the wedge 201, and a pair of opposite receiving channels 303 in a top face thereof. The front projection 301 defines a semi-annular recess 304 on a top face thereof in communication with the receiving channels 303. The vertical portion 31 comprises a pair of vertical through holes 311 respectively communicating with the receiving channels 303, a mounting hole 312, and a protrusion 313 extending forwardly from a bottom end thereof. The rear portions 32 together define a central channel 320 therebetween.

The mating contact 4 has a substantially cylindrical shape and comprises a contacting portion 41 at a front end thereof, a flange-shaped mounting portion 42 formed round a rear end of the contacting portion 41, and a tail portion 43 at a rear end thereof.

The spring contact 5 comprises a forked retaining portion 51, a ridge-like mating portion 52, and a switch portion 53 extending rearwardly from a rear end of the mating portion 52. The retaining portion 51 comprises a base plate 510, and a pair of opposite spring arms 511 extending rearwardly from a rear end of the base plate 510. A bent arm 54 extends downwardly from a rear end of the base plate 510 between the spring arms 511.

The switch contact 6 comprises a pair of parallel switch arms 61, a link portion 62 connecting rear ends of the switch arms 61, and a soldering arm 63 extending downwardly from one end of the link portion 62.

The LED 8 comprises an indicator 80 and a pair of conductive leads 81 extending from the indicator 80. Each lead 81 comprises a horizontal lead 82 extending rearwardly from a rear end of the indicator 80 and a vertical lead 83 extending downwardly from a rear end of the horizontal lead 82.

Figure 3:
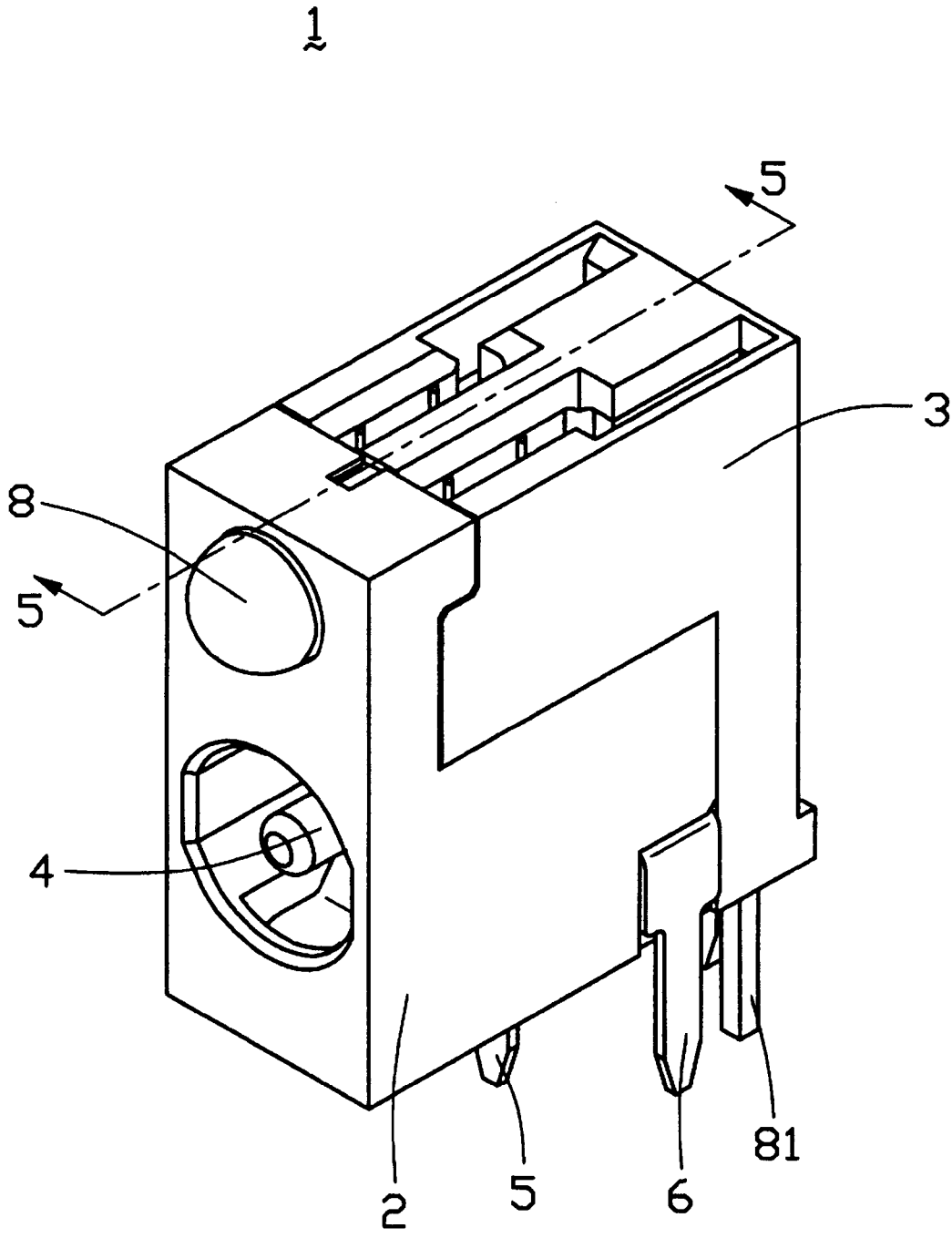
FIG. 3 is an assembled view of the power jack in FIG. 1.
Figure 4:
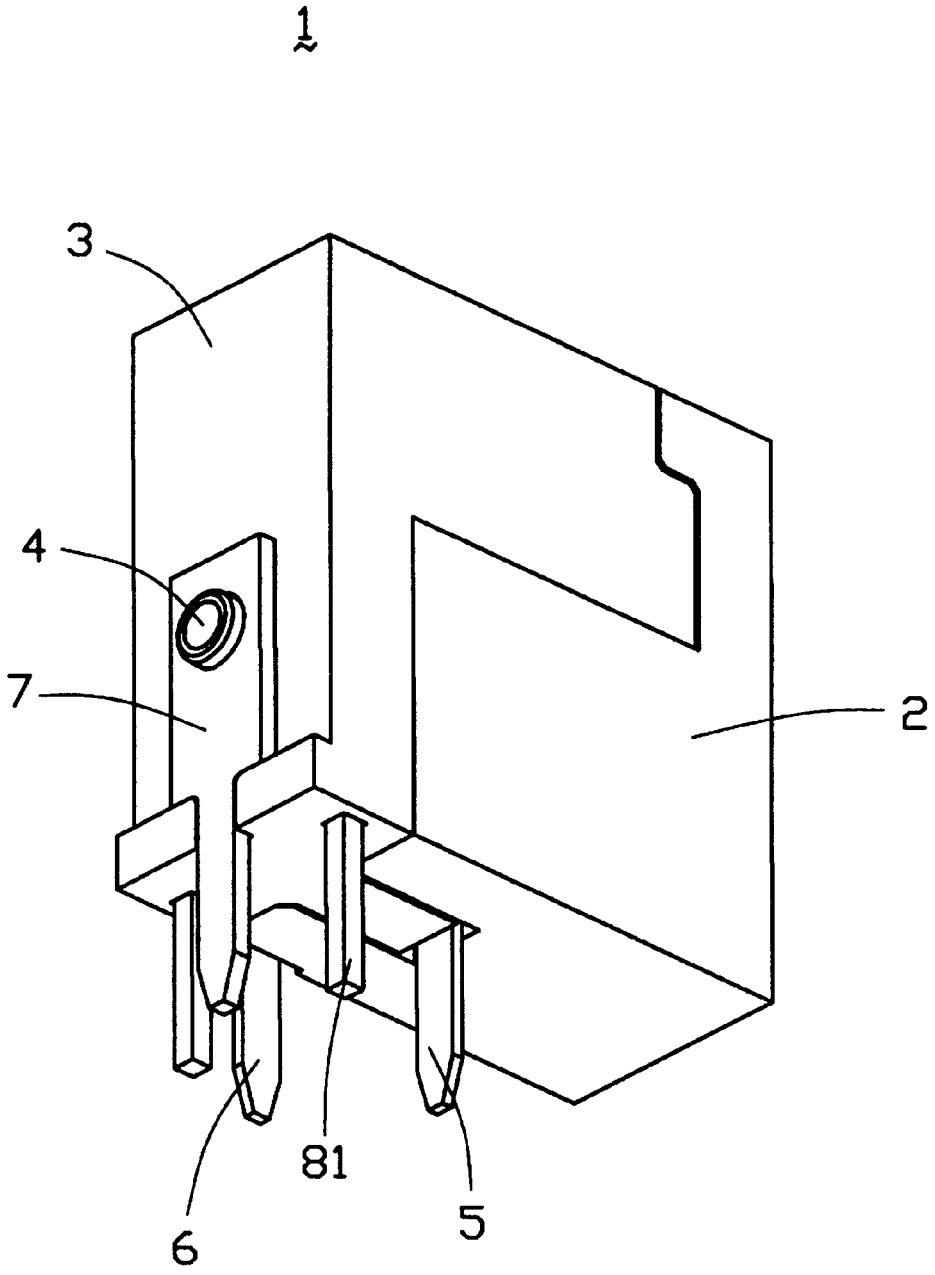
FIG. 4 is an assembled view of the power jack from another direction.
Figure 5:
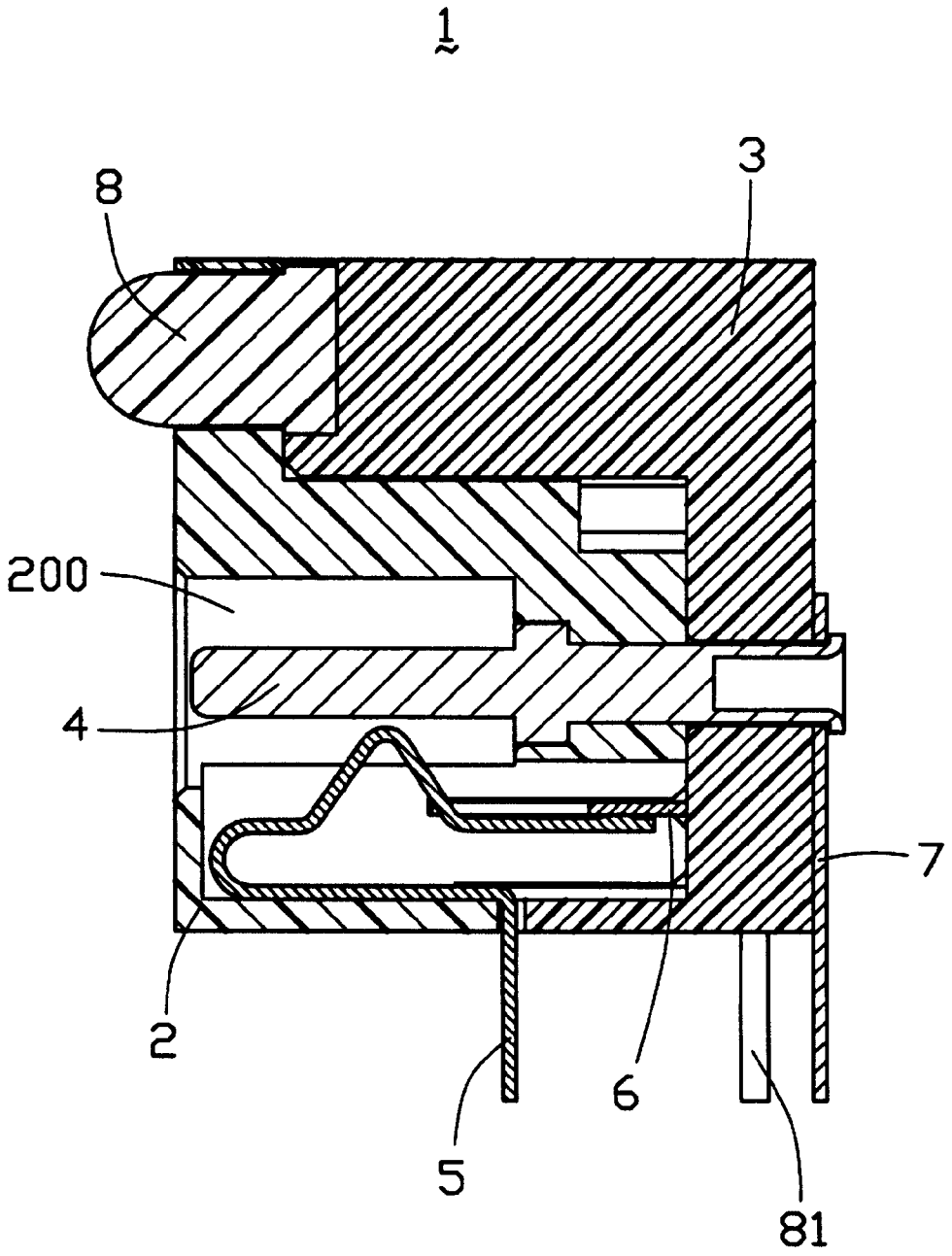
FIG. 5 is cross-sectional view taken along line 5—5 of FIG. 3.

Also referring to FIGS. 3–5, in assembly, the spring contact 5 is assembled in the front housing 2 with the spring arms 511 of the retaining portion 51 being received in the lower slots 204, and with the mating portion 52 together with the switch portion 53 being received in the rectangular recess 202. The bent arm 54 extends downwardly from the rectangular recess 202 for soldering on a printed circuit board (PCB) (not shown). Subsequently, the switch contact 6 is inserted into the front housing 2 with the switch arms 61 being received in the upper slots 203, and with the soldering arm 63 extending downwardly from the transversely exposed upper slot 203 to be soldered on the PCB. Meanwhile, the switch portion 53 of the spring contact 5 is located below and contacts with the link portion 62 of the switch contact 6. The LED 8 is assembled in the rear housing 3 from the top with the horizontal leads 82 of the conductive leads 81 being received in the receiving channels 303 and with the vertical leads 83 being received in the vertical holes 311. The indicator 80 is received in the semi-annular recess 304 of the front projection 301. Successively, the rear housing 3 is assembled on the front housing 2, with the wedge 201 engaged with the dove-tailed recess 302. The front projection 301 of the rear housing 3 is received in the retaining recess 210. The indicator 80 extends into the longitudinal hole 212, and the protrusion 313 of the rear housing 3 is received in a bottom portion of the rectangular recess 202 of the front housing 2 behind the bent arm 54 of the spring contact 5. Finally, the mating contact 4 is inserted into and extends through the aligned receiving passage 200 of the front housing 2 and the mounting hole 312 of the rear housing 3. The tail contact 7 is riveted on an exposed portion of the mating contact 4 and downwardly extends through the central channel 320 for being soldered to the PCB, thereby electrically connecting the mating contact 4 to the PCB.

Figure 6:
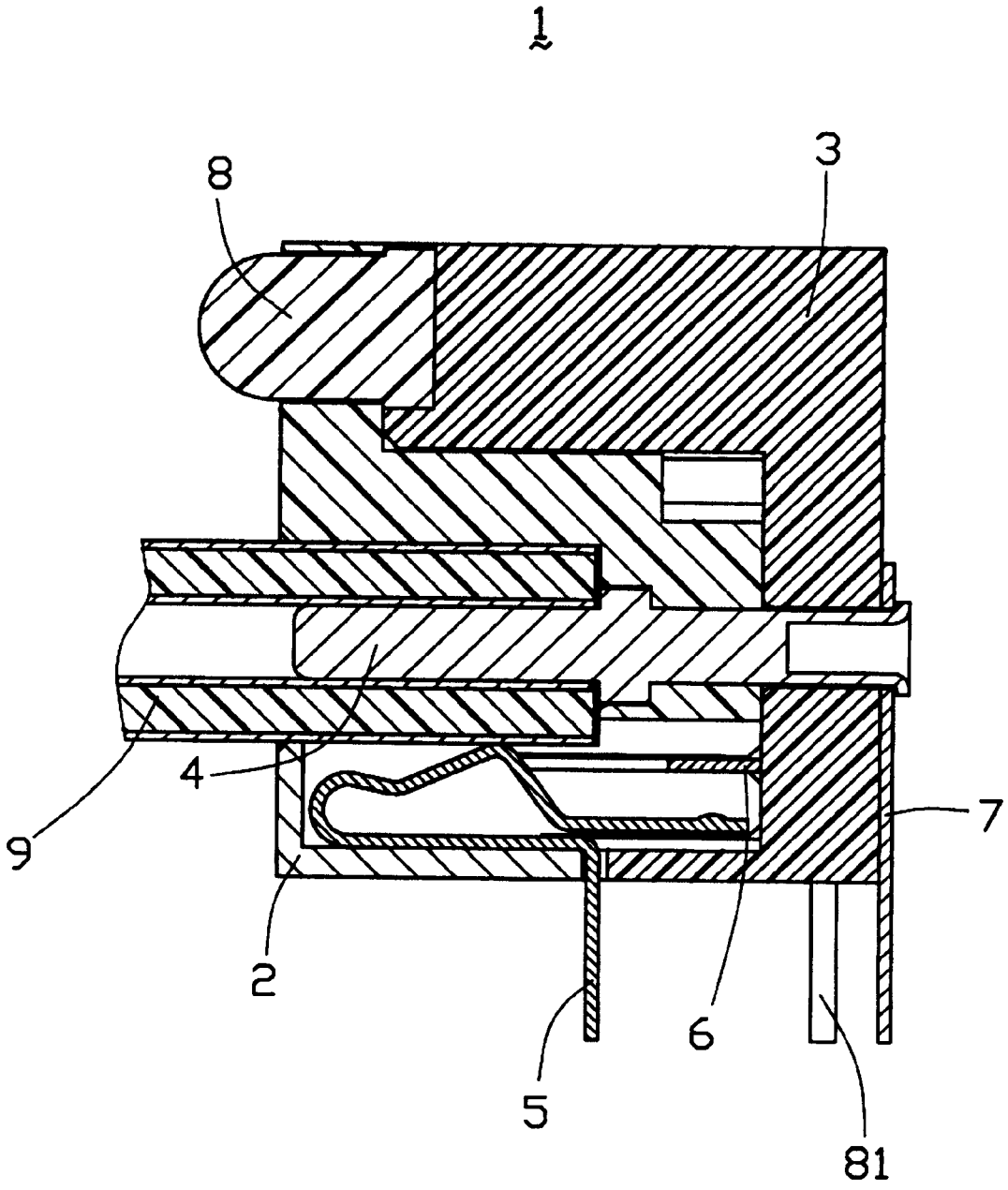
FIG. 6 is a cross-sectional view illustrating the engagement between the power jack and a complementary plug connector.

Referring to FIG. 6, in mating, when the complementary plug connector 9 is inserted into the receiving passage 200 of the front housing 2, the contact of the complementary plug connector 9 is electrically connected with the mating contact 4 and the spring contact 5. The spring contact 5 is pressed down by the contact of the complementary plug connector 9 and disengages from the switch contact 6, thereby establishing a current path between the plug connector 9 and the PCB through the mating contact 4, the tail contact 7, a circuit trace on the PCB, and the spring contact 5. If an electrical current circuit is achieved between the PCB and the plug connector 9, the indicator 80 of the LED 8 is on, otherwise the indicator 80 is off.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of a power jack mounted on a printed circuit board (PCB) and a complementary plug connector having a contact, the power jack comprising:

an insulative housing;

a mating contact assembled in the insulative housing for mating with the plug connector;

a spring contact assembled in the insulative housing and adapted for being connected to the PCB;

a switch contact assembled in the insulative housing and electrically engaged with the spring contact before the mating contact is engaged with the contact of the complementary plug connector;

a tail contact electrically connected with the mating contact and adapted for being connected to the PCB; and a light-emitting diode (LED) assembled on the insulative housing for indicating the working status of the power jack; wherein when the contact of the complementary plug connector is inserted into the insulative housing and engages with the mating contact and the spring contact, the spring contact disengages from the switch contact;

wherein the insulative housing comprises a front housing and a rear housing assembled to the front housing;

wherein the front housing comprises a bottom base and a top portion extending from a front end of the bottom base, and the rear housing comprises a top base assembled on the bottom base of the front housing and a vertical portion extending downwardly from a rear end of the top base.

2. The combination as described in claim 1, wherein the bottom base defines a receiving passage for receiving the mating contact and the contact of the complementary plug connector, and the top portion comprises a through hole to receive the LED.

3. The combination as described in claim 1, wherein the vertical portion of the rear housing comprises a hole in alignment with the receiving passage to receive the mating contact.

4. The combination as described in claim 1, wherein the spring contact comprises a retaining portion, and a ridge-like mating portion above the retaining portion for mating with the contact of the complementary plug connector.

5. An electrical connector, comprising:

a first housing defining a receiving hole;

a second housing assembled on the first housing and comprising a top base and a vertical portion, the top base defining a pair of receiving channels, the vertical portion defining a pair of vertical holes respectively communicating with the receiving channels;

a plurality of contacts assembled in the first housing for transmitting current; and a light-emitting diode (LED) comprising an indicator received in the receiving hole of the first housing, a pair of horizontal leads extending from the indicator and received in the receiving channels, and a pair of vertical leads extending downwardly from rear ends of the horizontal leads received in the vertical holes.

6. The power jack as described in claim 5, wherein the contacts comprise a mating contact adapted for contacting with a complementary connector, a spring contact adapted for being connected to a mating printed circuit board (PCB), a switch contact electrically engaged with the spring contact before the mating contact is engaged with the complementary connector, and a tail contact securing the mating contact to the second housing and adapted for being connected to the PCB.

7. An electrical connector comprising:

a first housing defining a receiving hole extending in an upper portion thereof along a horizontal direction, and a receiving passage extending in a lower portion along the horizontal direction;

a mating contact extending horizontally in said receiving passage;

a downwardly extending tail contact attached to a rear end of said mating contact; a second housing attached to the first housing;

a LED including an indicator at a front end and a pair of spaced leads extending rearwardly and downwardly therefrom; wherein said pair of leads are disposed by two sides of the tail contact;

wherein said LED is first downwardly installed to the second housing and successively associates with the second housing to be forwardly attached to the first housing under a condition that the indicator is restrainedly received within the receiving hole.

8. The connector as described in claim 7, wherein said second housing includes a vertical portion through which the mating contact extends, and the tail contact is positioned outside of said vertical portion.

* * * * *